United States Patent [19]

Tomadini

[11] 4,167,068

[45] Sep. 11, 1979

[54] TRANSPORT SYSTEM WITH SWINGING OR VIBRATING BELTS FOR THE DRYING OF LONG PASTA

[76] Inventor: Gino Tomadini, Viale Martelli 4, Pordenone, Italy, 33170

[21] Appl. No.: 839,305

[22] Filed: Oct. 4, 1977

[30] Foreign Application Priority Data

Oct. 18, 1976 [IT] Italy ..... 83463 A/76

[51] Int. Cl.[2] ..... F26B 9/00

[52] U.S. Cl. ..... 34/164; 99/451; 198/411

[58] Field of Search ..... 34/164; 198/411, 416, 198/752, 754; 99/451

[56] References Cited

U.S. PATENT DOCUMENTS

| | | | |
|---|---|---|---|
| 3,568,859 | 3/1971 | Truesdell | 198/411 |
| 4,094,123 | 6/1978 | Carlson | 198/752 |

FOREIGN PATENT DOCUMENTS

| | | | |
|---|---|---|---|
| 933799 | 8/1963 | United Kingdom | 34/164 |

*Primary Examiner*—Edward G. Favors
*Attorney, Agent, or Firm*—Henry M. Bissell

[57] ABSTRACT

A transport system for the drying of spaghetti or other long pasta includes swinging or vibrating belts to align the pasta in bunches of parallel lengths, at the same time moving so as to prevent the pasta from sticking together, thereby facilitating the drying of the individual pasta lengths. Principally, conveyor belts or the like are mounted with sufficient slack which, combined with cross bars and side supports, forms a series of transverse depressions into which the pasta is concentrated. The depressions shift linearly as the belt moves, thus preventing the pasta from sticking together. Various arrangements are provided causing vibration of the belts in addition to the forming of the depressions.

12 Claims, 6 Drawing Figures

TRANSPORT SYSTEM WITH SWINGING OR VIBRATING BELTS FOR THE DRYING OF LONG PASTA

BACKGROUND OF THE INVENTION

1. Field of the Invention

The present invention relates to a transport system with vibrating belts for the drying of spaghetti and all other types of long pasta.

2. Description of the Prior Art

It is well known in the art, that for the transport of spaghetti and other long pasta presently during the drying process, pipes are used to hang the pasta up on them or frame on which the pasta is spread-out, or otherwise rotating cylinders, containers or baskets are used.

These techniques serve both purposes, first to favor the drying process and second to prevent the said pasta to cling together.

The installations for all these drying methods are very complicated and need remarkably large space.

Furthermore, the costs for the second type of installation are considerably high on account of the idle return and the operation for the loading and discharge etc.

Against the basket method speaks the fact, that besides being extremely complicated and expensive, it needs also a maximum of labor to conduct the drying process.

Therefore, the purpose of the present invention is to realize a simple and inexpensive transport system without the mentioned drawbacks.

SUMMARY OF THE INVENTION

The present invention has the particular scope to equip conveyor-belts used for the transport of the pasta with transverse supports which slide together with the belt resulting in a series of continuous depressions in the belt, (this way giving the impression as if the belt is not really stretched) and at the same time giving the belt a vibration or a swinging motion, giving to the pasta which accumulates in the said depressions also a swinging motion and forcing it to move with the advancement of the belt and to arrange itself one beside the other and along the said depressions or bumps of the said belt which for this purpose is furnished with holes or consists of mesh to allow an adequate ventilation from below or above for the said drying process.

The present invention therefore uses conveyor-belts similar to the ones used for the drying of cut-up pasta, equipped with devices suitably constructed for the advancement of the product, which is already cut up to the length desired for the wrapping-up, at the same time forcing it to proceed in the normal direction, the same as the conveyor-belt advances without piling-up and also taking a shape and position perfectly rectilinear.

The so conceived system improves substantially the drying procedure, allows to effect it with extremely simple installations of low costs and furthermore allows to unite the criteria of the drying machines for long and cut-up pasta, permitting use with both types of pasta of the same advancement system utilizing belts with some additional devices with regard to the long pasta complying with the present invention.

To use the advancement on belts even for long pasta, slight concavities of mesh in the conveyor belts are established instead of them being perfectly straight. The belts are installed between cross-pieces which serve to form the said slight depressions. This fact together with giving the belts a vibration or swinging motion, preferably in the lengthwise direction to compel, as said before, the strings of pasta to arrange themselves in a perfect manner, rectilinear and parallel one beside the other, without piling-up and in a normal position in relation to the advancement of the belt.

The present invention may also be realized by replacing the belt for the advancement of the product by a series of metallic blinds, suitably perforated and shaped to build a series of slight concavities on which the long pasta is moving along rectilinear and without piling up. Naturally the said blinds are also given the said vibrations besides the advancing motion.

The swinging motion or vibration of the conveyor-belt may be obtained with different methods, for example with the assistance of a crank mechanism or the like, of driven weights or eccentrics, with air compression, electromagnets or even by having the belts advance in jerks, or with a crank-shaft, which is part of the axis of one of the rollers for the advancement of the conveyor-belts.

To reach the wanted scope, the width or the distance of the concavities between two cross-pieces of the mesh-belts or the metallic perforated blinds has no great importance and may be a few decimeters or even a few centimeters, but it is very important for the concavities of the mesh-belts or metallic blinds to be at least a few millimeters deep so that the swinging motion compels the product to slightly stir and settle on the respective depression of the belt.

The conveyor-belt may also be built to transport not only one but a few lines of the product one beside the other. In such cases longitudinal partitions are provided to contain and guide the product in the proper aisle. In this manner, each series of strings of long pasta, cut-up to the right measurement for the wrapping-up, will be guided in its own aisle for the entire drying period throughout the various successive elements of the drying process.

In cases, where the advancement of the product is obtained by metallic blinds the guides or partitions to build the aisles are preferably directly incorporated into the blinds. In cases of advancement on mesh-belts, the partitions may be formed by loose chains or stiff elements of flexible and elastic material which adjust themselves to the depressions of the belt.

BRIEF DESCRIPTION OF THE DRAWING

The present invention will be better understood with the assistance of the enclosed drawings which illustrate different non-limiting schematic types of execution of conveyor-belts according to the present invention.

BRIEF DESCRIPTION OF THE PREFERRED EMBODIMENT

Figure 1:
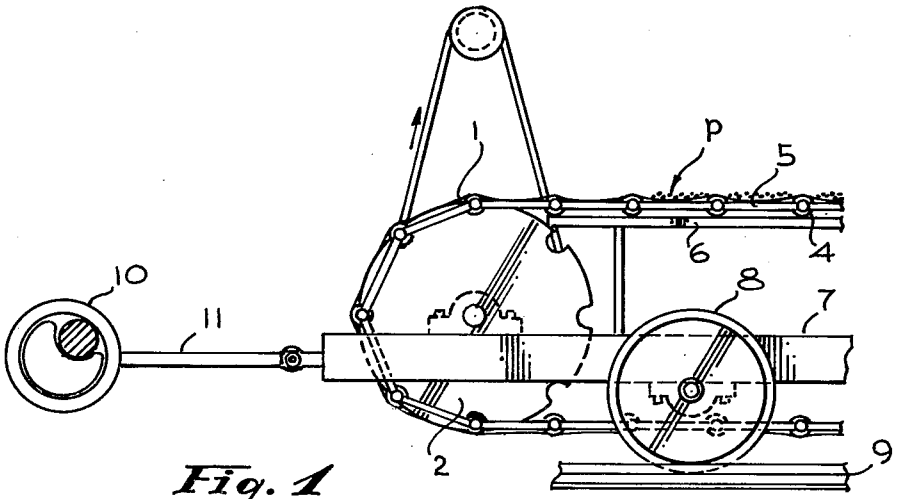
FIG. 1 shows a side-view of the initial part of a conveyor-belt in a first embodiment of the present invention.

From FIG. 1 it may be noted that the conveyor belt 1 for the pasta p is not kept tight. It is supported by at least two pulleys 2, 3 and at least one of them is the driving type; i.e. No. 2 in FIGS. 1, 2 and 5, 6 and No. 3 in FIGS. 3, 4).

The mesh-belt is furthermore equipped with cross-pieces 4 which are supported by end-chains 5 taut to the pulleys 2, 3 which are toothed on their outside, to guide and strain the said chains 5. To avoid any sinking of the cross-pieces 4 they or their chains may be guided by one or more slides 6 along all of their length.

The pulleys 2, 3 are mounted on a frame 7 which connects them rigidly and adjustably to the respective tightening of the belt.

Figure 2:
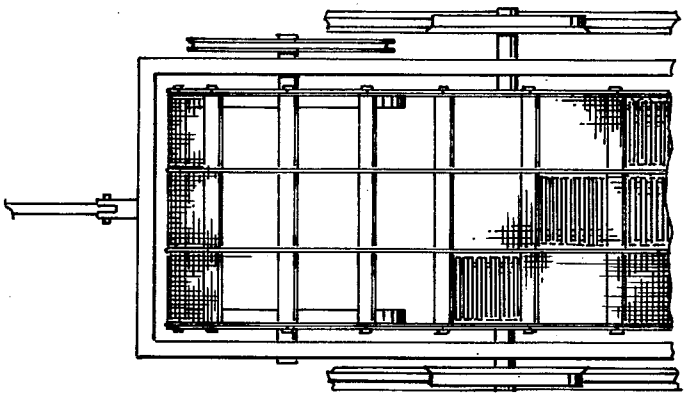
FIG. 2 represents a top-view of the conveyor-belt part shown in FIG. 1.
Figure 4:
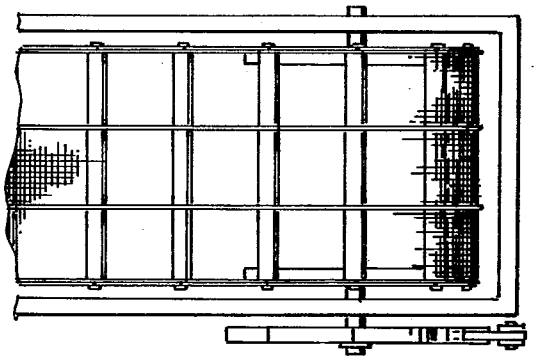
FIG. 4 represents a plan view of the embodiment shown in FIG. 3.
Figure 6:
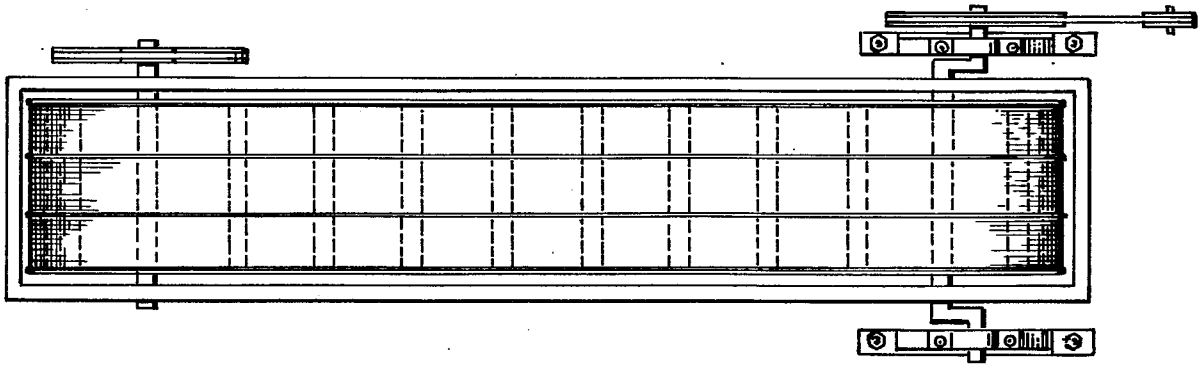
FIG. 6 represents in a plan view of the same belt as in FIG. 5 visualizing various aisles for the transport of the pasta.

Therefore between adjacent cross-pieces 4 a depression of the belt 1 is formed where the spaghetti p are disposed. Furthermore the belt 1 may be lengthwise divided in aisles using suitable means to transport different lines of spaghetti, as illustrated in FIGS. 2, 4, 6. These partitions may be realized in any suitable form for the transport of the pasta.

According to FIGS. 1, 2 the frame 7 is mounted movable on wheels 8 which are set on a platform or rails 9 and in addition to the advancement motion caused by the pulley 2 there is a independently swinging motion of the frame, caused by the eccentric wheel 10 with the respective arm 11.

Figure 3:
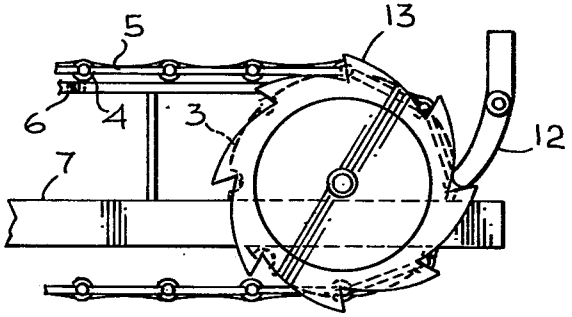
FIG. 3 represents the same view as in FIG. 1 with a variation in the vibration given to the belt contemporary with the advancement motion.

In the alternative embodiment shown in FIG. 3 provides the advancement motion of the belt 1 in jerks by means of a ratchet brace 12 engaged with a toothwheel 13 coaxial to the pulley 3 and fitted closely to it to pull the belt.

Figure 5:
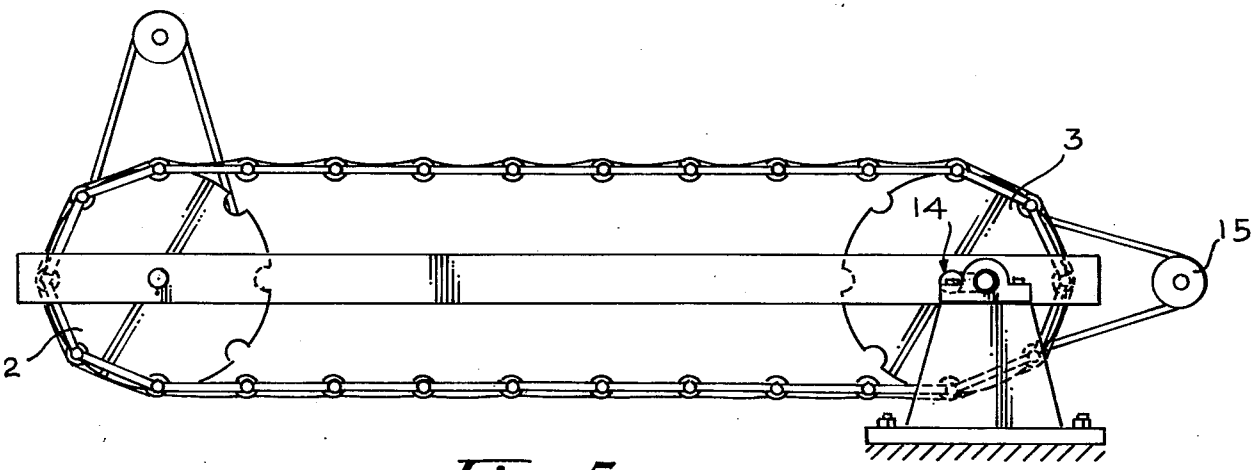
FIG. 5 represents a schematic side-view of the said belt in another form of execution.

The arrangement shown in FIGS. 5, 6 instead provides a swinging motion of the belt progressively increasing and decreasing depending on the direction of the motion of the belt, since it is furnished with an independent motion 15 of an eccentric wheel 14 on one of the towing pulleys as illustrated in FIG. 3 (but obviously it could be as well the opposite case.)

The solution shown in the last two figures illustrates that the swinging motion is not linear but follows a curved trace, whereas FIG. 1 illustrates a linear arrangement, alternating in both directions and the arrangement of FIG. 3 is linear and in jerks in only one direction.

Naturally the same vibration as given to the pulley 3 (FIG. 5) may be given as well to the pulley 2 or to the frame that supports both of them to obtain an equal swinging motion for all the length of the belt.

Finally the particulars of the execution may vary but without changing the substance of the invention as specified, illustrated and claimed in the appended claims.

What I claim is:

1. A system for transporting spaghetti and long pasta laterally during a drying process comprising:
   - perforated conveying means loosely suspended between opposed end wheels;
   - means for supporting the conveying means between the end wheels so as to develop a series of transverse depressions for containing the pasta therein;
   - means coupled to at least one of the end wheels for driving the conveying means; and
   - means for vibrating the conveying means in a manner such that the pasta transported thereon is arranged in parallel alignment in said depressions and is regularly moved relative to the conveying means and to itself.

2. The system of claim 1 wherein the vibrating means includes means for causing the driving means to drive the conveying means irregularly and spasmodically.

3. The system of claim 2 wherein the drive means includes a ratchet mechanism for rotating an associated end wheel in a jerking motion to advance the conveying means spasmodically.

4. The system of claim 1 wherein the end wheels are supported on a frame and further including a plurality of support wheels mounted to the frame and supported on rails for ready movement in a direction generally parallel to the movement of the conveying means, and means attached to the frame for driving the frame back and forth on said support wheels and rails in a cyclic motion as the conveying means are driven by the end wheels.

5. The system of claim 4 wherein the means attached to the frame comprise a rotating eccentric member.

6. The system of claim 1 wherein the vibrating means comprises one of the end wheels mounted eccentrically relative to its center of rotation and means for driving said one end wheel to rotate eccentrically.

7. The system of claim 1 wherein the conveying means comprises a mesh belt supported by regularly spaced transverse support members secured at opposite ends to a pair of endless spacing means so as to develop a plurality of depressions in the belt, one between each pair of adjacent cross pieces.

8. The system of claim 1 wherein the conveying means comprises a plurality of metallic blinds defining shallow pockets extending transversely of the conveying means for receiving the pasta in parallel alignment therein.

9. The system of claim 1 further including longitudinal dividers mounted on the conveying means for dividing the conveying means into a plurality of drying lines.

10. The system of claim 1 wherein the vibrating means is operative to vibrate the conveying means only in the direction of advancement of the conveying means.

11. The system of claim 1 wherein the vibrating means is operative to swing the conveying means back and forth relative to the direction of movement of the conveying means.

12. The system of claim 1 wherein the vibrating means is operative to swing the conveying means in a circular trajectory.

* * * * *